United States Patent [19]

Curiel

[11] Patent Number: 4,778,031

[45] Date of Patent: Oct. 18, 1988

[54] ESCAPE CHUTE

[75] Inventor: Yoram Curiel, Aurora, Colo.

[73] Assignee: Dynavac, Inc., Aurora, Colo.

[21] Appl. No.: 133,328

[22] Filed: Dec. 16, 1987

[51] Int. Cl.[4] ..... A62B 1/20

[52] U.S. Cl. ..... 182/47; 182/48; 193/25 R

[58] Field of Search ..... 182/48, 49, 47; 193/25 R, 25 C

[56] References Cited

U.S. PATENT DOCUMENTS

| | | | |
|---|---|---|---|
| 208,944 | 10/1878 | Wohlmann . | |
| 1,015,937 | 1/1912 | Brevetti et al. . | |
| 2,734,611 | 2/1956 | Gordon | 193/7 |
| 3,348,630 | 10/1967 | Yamamoto | 182/48 |
| 3,811,534 | 5/1974 | Fisher | 182/48 |
| 3,968,856 | 7/1976 | Keen et al. | 182/48 |
| 3,973,644 | 8/1976 | Zephinie | 182/47 |
| 3,977,495 | 8/1976 | Zephinie | 182/48 |
| 3,994,366 | 1/1976 | Okuma et al. | 182/48 |
| 4,005,762 | 2/1977 | Zephinie | 182/48 |
| 4,099,595 | 7/1978 | Tracy | 182/48 |
| 4,099,596 | 7/1978 | Tracy | 182/48 |
| 4,122,934 | 10/1978 | Nieto de Moreno | 193/32 |
| 4,162,717 | 7/1979 | Orii et al. | 182/48 |
| 4,164,990 | 8/1979 | Stiefel et al. | 182/48 |
| 4,240,520 | 12/1980 | LaGrone et al. | 182/48 |
| 4,246,980 | 1/1981 | Miller | 182/48 |
| 4,339,019 | 7/1982 | Tracy | 182/47 |
| 4,398,621 | 8/1983 | Baker | 182/48 |
| 4,434,870 | 3/1984 | Fisher | 182/48 |
| 4,476,670 | 10/1984 | Ukai et al. | 56/328 R |
| 4,681,186 | 7/1987 | Leisman et al. | 182/47 |

FOREIGN PATENT DOCUMENTS 9947 of 1908 United Kingdom .

*Primary Examiner*—Reinaldo P. Machado
*Attorney, Agent, or Firm*—Arnold B. Silverman

[57] ABSTRACT

The escape device of the present invention comprises an escape chute having an outer and an inner tube, the outer tube consisting of heat resistant material which surrounds the inner tube, the inner tube having a panel extending over a major portion such that an object in the chute contacting the panel will have its rate of descent retarded. A mounting bracket is associated with the upper end of the chute, the inner tube being attached to the mounting bracket such that a tapered entry from the upper end of the chute to a point below the upper end of the chute is formed. The outer tube is attached to the mounting bracket independent of the inner tube, so that the outer tube does not have to absorb load-carrying stress associated with objects descending in the chute. An air gap for insulation and ventilation is formed between the inner and outer tube.

29 Claims, 5 Drawing Sheets

ESCAPE CHUTE

BACKGROUND OF THE INVENTION

1. Field of the Invention

This invention relates to apparatus for use in escaping from emergency situations and, more specifically, it relates to an improved chute through which individuals may escape.

2. Description of the Prior Art

It has been known to provide various means of emergency escape devices for use in buildings, on vessels at sea and for other locations where emergency evacuation may be required in order to prevent death and prevent or minimize injuries resulting from disasters such as fires, explosions or other situations making it desirable for individuals to be safely and rapidly evacuated.

U.S. Pat. Nos. 4,099,595; 4,099,596; and 4,339,010 disclose the use of chutes as escape devices. Disclosed are systems wherein the chutes contain discrete local braking elements which are adapted to retard the rate of descent of an individual employing the same. These disclosures also contain reference to a landing pad disposed at the bottom of the chute to facilitate the transition between generally vertically directed descent within the chute and discharge therefrom onto land. See also U.S. Pat. Nos. 4,164,990 and 4,246,980. The former discloses slide fasteners in evacuation apparatus.

U.S. Pat. Nos. 3,973,644; 3,977,495 and 4,005,762 disclose multiwalled chutes which are said to be elastic in a circumferential direction, but not in a longitudinal direction. These patents also disclose a protective tube 12 made of fire resistant material that is spaced from and surrounds inner tubes 11 and 15. The tubes 11 and 15 and the thermal protection 12 are all mounted on separate annular tubular rings 14, 14' and 14'', respectively.

U.S. Pat. No. 3,944,366 discloses a system having a cylindrical outer tube and a zig-zag inner tube with the latter being said to reduce the rate of descent.

U.S. Pat. No. 4,122,934 discloses a chute having an elastomeric coating which is said to provide similar coefficients of friction in both wet and dry conditions. See also U.S. Pat. No. 4,434,870.

British Pat. No. 9,947 (1908) discloses a protective outer chute which houses a pad which in turn is secured to a cable.

U.S. Pat. No. 4,681,186, which has a common assignee as the present invention, discloses an escape chute having zipper means along its longitudinal extent to permit exit from the chute at discrete points along its longitudinal extent and also having a friction creating panel disposed interiorly of and extending a major portion of the chute's longitudinal extent.

There remains a need for an improved escape chute having an upper entrance portion which is easy to get into and which helps to alleviate the fear of persons using the chute. There is also a need for a strong and reliable mounting system for the chute in order to hold the weight of those using the chute. Also, a chute is needed which provides for ventilation of the inside of the chute in order to alleviate smoke inhalation problems and to provide active as opposed to passive air between the chutes.

It will be appreciated, therefore, that there remains a need for an improved escape chute.

SUMMARY OF THE INVENTION

The present invention has met the above-described need.

The escape device of the present invention comprises an escape chute having an outer tube and an inner tube, the outer tube which surrounds the inner tube is made of heat resistant material, the inner tube has a lining which extends over a major portion such that an object descending within the chute contacting the panel will have its rate of descent retarded. Mounting means are associated with the upper end of the chute, the inner tube being attached to the mounting means such that a tapered entry from the upper end of the chute to a point below the upper end of the chute is formed. The outer tube is attached to the mounting means independent of the inner tube, so that the outer tube does not have to support loads created by the person or object descending in the chute. An air gap for insulation and ventilation is formed between the inner tube and heat resistant outer tube.

It is an object of the invention to provide an escape chute which provides a safe and reliable system for assisting persons in escaping buildings and the like in times of emergency.

It is a further object of the invention to provide fire departments and other emergency personnel with the capability of rescuing persons from buildings having nonoperational or no escape means.

It is a further object of the present invention to provide an improved escape chute which will eliminate some of the view of the ground while individuals who will use the chute look down the chute, and will in turn minimize fear and panic of those using the chute.

It is a further object of the invention to provide an escape chute wherein ventilation is provided to resist smoke penetration and heat build-up inside the chute.

It is a further object of the present invention to provide an escape chute with a monting device which eliminates the need for stitching together or otherwise securing the outer and inner tubes.

It is a further object of the invention to provide an escape chute in which the outer tube has no substantial load applied to it except its own weight.

These and other objects of the invention will be more fully understood from the following description of the invention on reference to the illustrations appended hereto.

DESCRIPTION OF THE PREFERRED EMBODIMENTS

Figure 1:
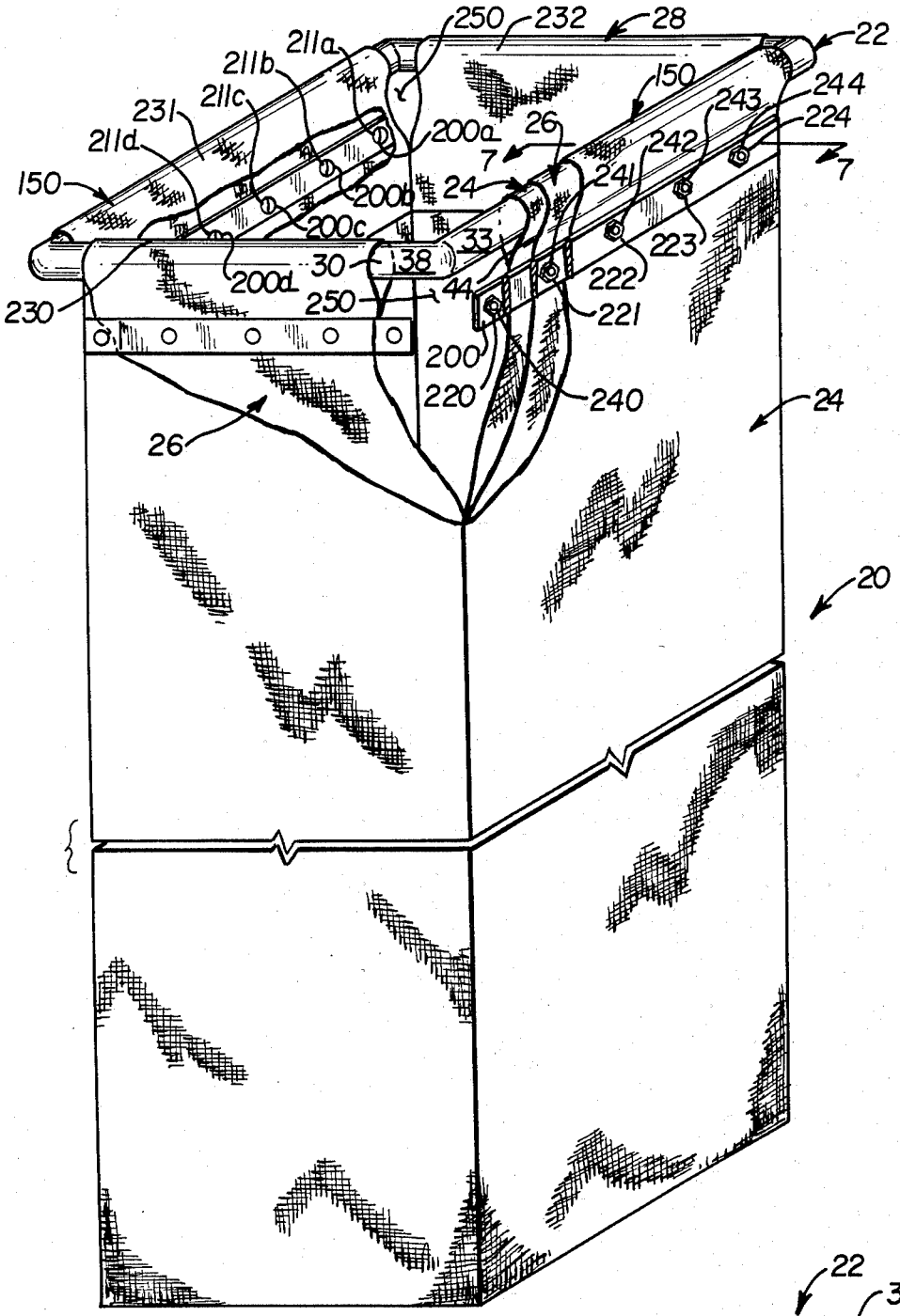
FIG. 1 is a perspective view, partially in section, of the escape chute of the present invention.

Referring now to FIG. 1, the escape chute is shown. The chute in the form shown consists of a square mounting bracket 22 upon which is mounted an outer tube 24, an inner tube 26 and a liner flap 28. Each of these elements will be discussed in detail hereinbelow.

The chute can be mounted on the platform of the top of a fireman's ladder or a fire truck "cherry-picker", for example, as is well known to those skilled in the art, or the chute can be mounted onto the side of a building as was disclosed in U.S. Pat. No. 4,681,186, which disclosure is expressly incorporated herein by reference. The mounting system provides for portability of the chute and also flexibility for positioning of the chute 20 in time of emergency.

Preferably, the chute will be normally folded so that it may be conveniently stored until needed. When the chute is folded it can be covered, if desired. The chute 20, when needed, can then unfold in any desired manner to any desired length.

Figure 2:
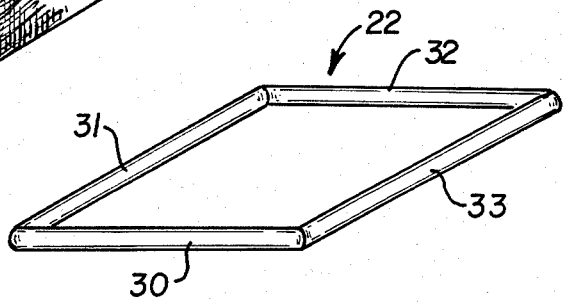
FIG. 2 is a perspective view of a form of the mounting bracket.

FIG. 2 shows the mounting bracket 22 only. The bracket is preferably a closed frame and in the form shown is square in shape and is made up of four bracket members 31, 32, 33, and 34. The four bracket members 30–33 are preferably substantially rigid and may be tubular with a diameter of about 1 to 4 inches, with about 2 to 3 inches being preferred. The length of the tube members 30–33 is preferably about 18 to 36 inches, with about 22 to 26 inches being preferred. The tube members 30–33 are preferably composed of a durable substantially rigid material which has sufficient strength to support the chute and the load of persons or objects being evacuated. A material such as a high strength aluminum, for example, 1361 grade aluminum can be used. The tube members 30–33 can be joined by welding or can be formed as a unit as by bending to form a unitary mounting bracket 22. Also, the bracket 22 can be die cast from aluminum or iron.

It will be appreciated that the shape, size, and materials disclosed are not limitations on the invention and suitable shapes, sizes, and materials may be substituted therefor.

Figure 3:
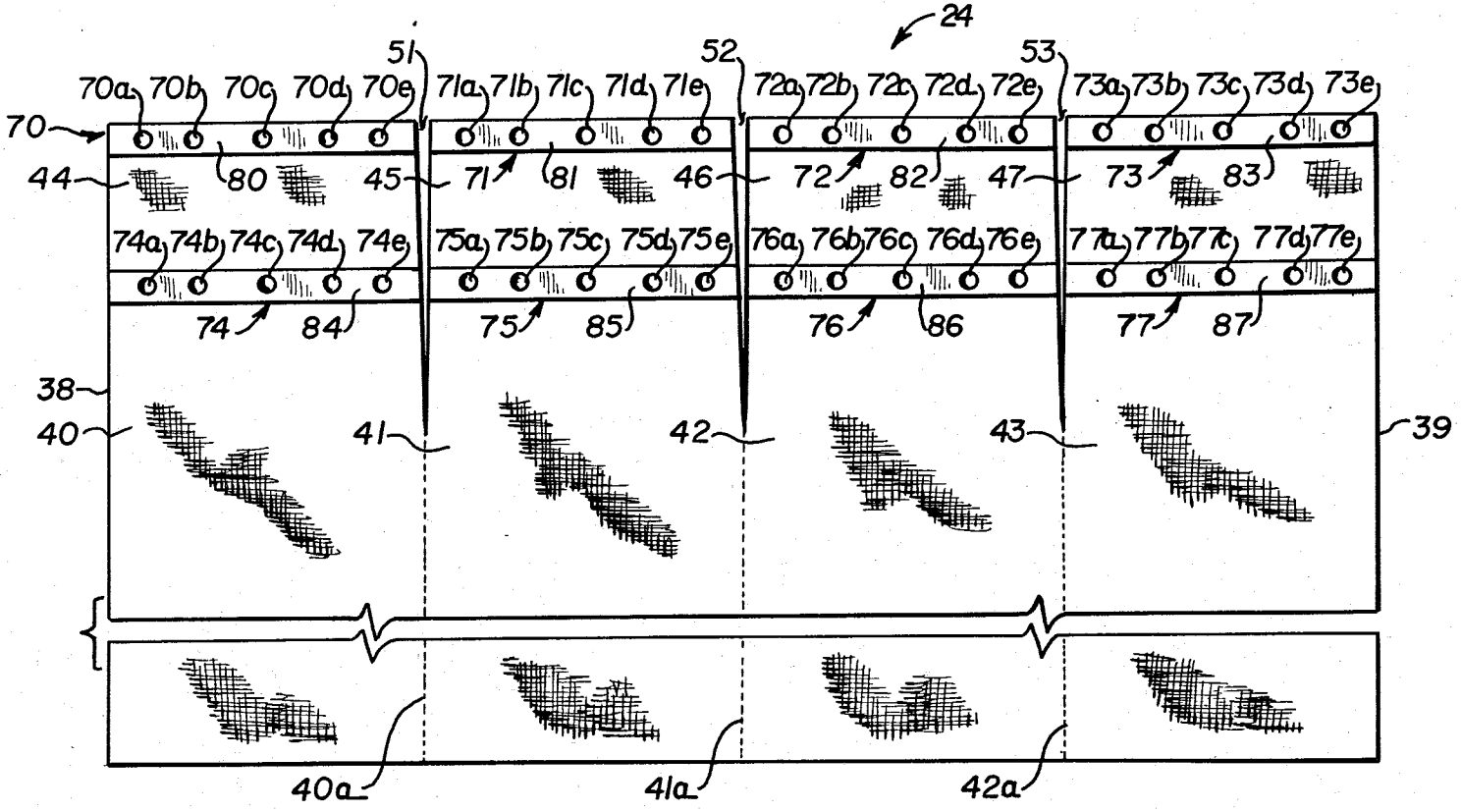
FIG. 3 is a partial front elevational view of the outside of the outer tube of the escape chute before it is mounted on the mounting bracket.

FIG. 3 shows a partial view of the outer tube 24 before it is mounted on the mounting bracket 22. The outer tube 24 has an upper edge 37, a lower edge (not shown) and two side edges 38 and 39.

Outer tube 24 is made of a heat resistant material such as carbon aramid fiberglass (16 oz per yard) and sold under the trade designation "GENTEX 1015". The outer tube 24 serves to provide an outer shield which resists injury to the user and overheating of the inner tube 26 interior.

As can be seen in FIG. 3, the outer tube 24 preferably consists of four separate sections 40–43 of material stitched together to form a shield whose upper edge 37 is about 20 to 40 inches wide with 24 to 36 inches being preferred and whose side edges 38 and 39 are 10 to 150 feet long with about 80 to 120 feet being preferred. The sections 40–43 are stitched together at preferably three seams, 40*a*, 41*a*, and 42*a* to form the outer tube 24. Preferably, the stitching used is fire resistant Kevlar thread, but fiberglass or nylon can be used, if desired. It will be appreciated that two, three, or more than four sections can be used to form the outer tube.

As can be seen in FIG. 3, the seams 40*a*–42*a* terminate at a point below the uppermost edge of the outer tube 24. Thus, flaps 44, 45, 46, and 47 which define gaps 50, 51, and 52 are formed at the upper edge 37 of the outer tube 22. Each flap is about 18 to 26 inches wide, with about 20 to 23 inches being preferred, thus creating a gap having a width of about 2 to 6 inches, with 3 to 5 inches being preferred, near the upper edge 37 of the outer tube 24. The flaps 44–47 are generally tapered from the upper edge 37 to the uppermost part of their respective seams 40*a*–42*a*.

Disposed on each flap 44–47 is an upper row of bolt holes 70, 71, 72, and 73 each row containing preferably five bolt holes 70*a–e* to 73*a–e* and a lower row of bolt holes 74, 75, 76, and 77, each row containing, preferably five bolt holes 74*a–e* to 77*a–e*, respectively. The bolt holes, 70*a–e* through 77*a–e* are used to mount the outer tube 24 onto the mounting bracket 22 as will be explained hereinbelow. The bolt holes 70*a–e* to 77*a–e* are all of the same diameter which can range from $\frac{3}{8}$ to 1 inch with $\frac{1}{2}$ to $\frac{3}{4}$ inches being preferred. In addition, each row 70–77 is reinforced by a high grade webbing 80, 81, 82, 83, 84, 85, 86, and 87. As can be seen from FIG. 3, the upper row 70–73 bolt holes 70*a–e* to 73*a–e* are longitudinally aligned with the lower row 74–77 bolt holes 74*a–e* to 77*a–e* such that bolt hole 70*a* is aligned with bolt hole 74*a*, for example. The vertical spacing between the upper row 70–73 bolt holes 70*a–e* to 73*a–e* and the lower row 74–77 bolt holes 74*a–e* to 77*a–e* is sufficient to permit wrapping of the flaps 44–77 around the mounting bracket 22 as will be discussed with reference to FIG. 7.

Figure 4A:
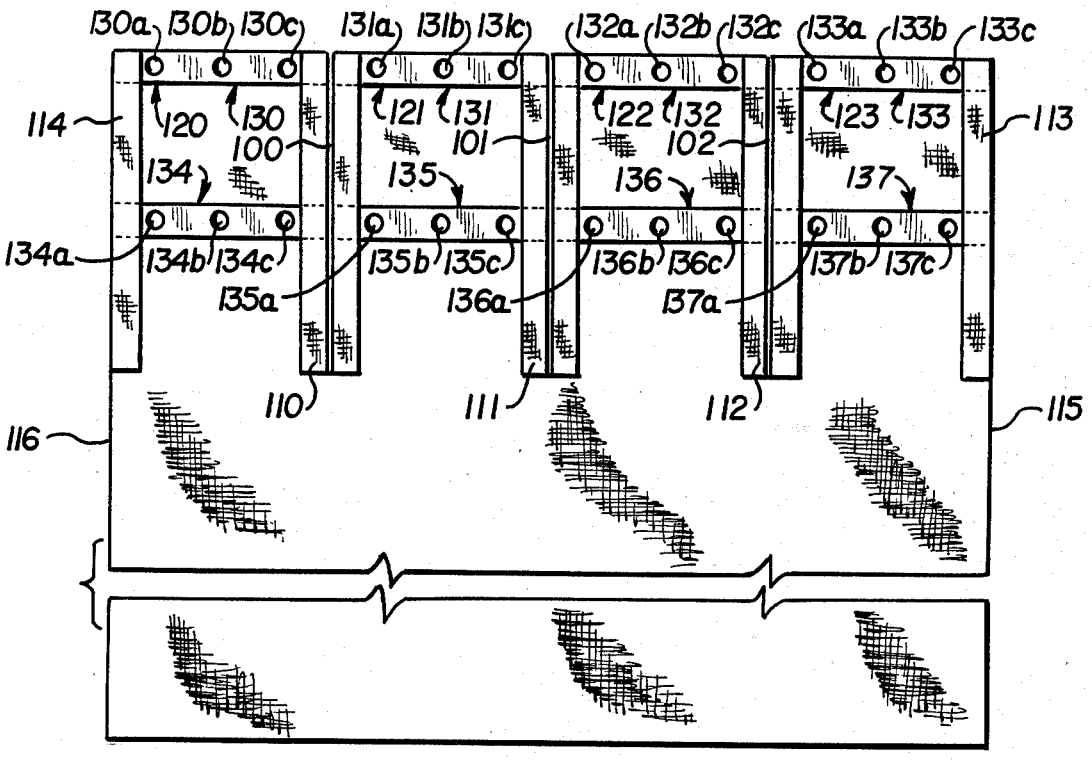
FIG. 4A is a partial front elevational view of the outside of the inner tube of the escape chute before it is mounted on the mounting bracket.

FIG. 4A shows a partial front elevational view of the inner load-carrying tube 26. Inner tube 26, before mounting to the bracket, preferably consists of a rectangular piece of material about 50 to 70 inches wide, with about 55 to 65 inches being preferred and 10 to 150 feet long with about 80 to 120 feet being preferred, depending on the length of the outer tube 24. The inner tube 26 has a panel which serves to provide a continuous generally longitudinally oriented member to slow the rate of descent of an individual descending within the tube. FIG. 4A shows a friction-creating panel 90 which is preferably composed of a material which has a higher coefficient of friction than a remaining portion of inner tube 26. It also has a circumferential extent which is preferably less than the full circumference of the inner tube 26. If desired, two or more such panels may be employed.

Figure 4B:
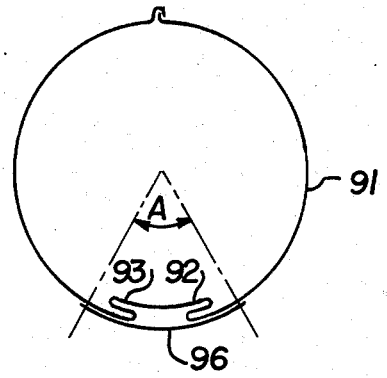
FIG. 4B is a schematic cross-sectional illustration of a modified form of the inner tube in restricted position.
Figure 4C:
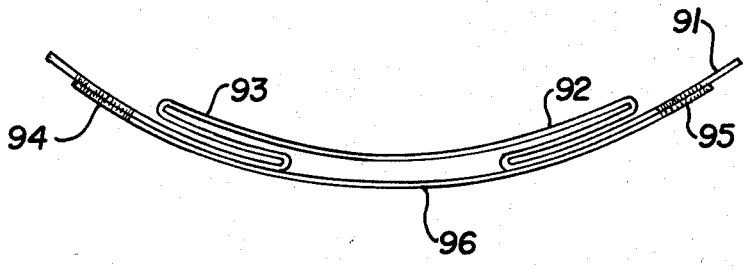
FIG. 4C is an enlarged illustration of a pleated portion of FIG. 4A.
Figure 4D:
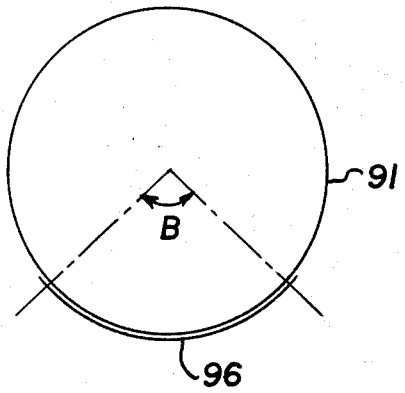
FIG. 4D is a schematic cross-sectional illustration of the structure of FIG. 4A in expanded position.

FIGS. 4B, 4C, and 4D show an alternate panel which serves to provide a continuous generally longitudinally oriented member to slow the rate of descent of an individual descending within the chute. This can be used in addition to or in lieu of the friction creating panel 90. As shown in FIGS. 4B and 4C, the inner tube 91 can be made of non-expanding material. The tube 91 is provided with pleats 92, 93 secured to the inner tube 91 by any suitable means such as stitching at 94, 95. An elastic material 96 is disposed between the pleats 92, 93 and the tube 91. The inner tube 91 in unstretched condition is preferably of sufficiently small diameter as to be in intimate engagement with a person descending in the chute. To the extent to which a person is larger than the opening, the elastic panel 96 will expand thereby causing expansion of the inner tube 91 while remaining in intimate contact with the person. FIG. 4D shows the inner tube 91 with the pleats 92 and 93 expanded against the resistance of the elastic material. This resilient effect will retard the rate of descent. The expanded elastic material covers an arc corresponding to angle B which is greater than angle A (FIG. 4B).

The inner tube 26, unlike the outer tube 24, starts as one large piece of material and is the cut preferably at three cut lines 100, 101, and 102. These cut lines 100–102 are about 18 to 36 inches long with about 20 to 28 inches being preferred. The material on either side of cut lines 100–102 is reinforced by a heavy grade webbing material indicated at 110, 111, and 112. The webbing material 110–112 surrounds the cut lines 100–102 and extends below the cut lines 100–102 to provide a stronger material around the cut lines 100–102 to prevent ripping of the inner tube 26. Webbing material 113 and 114 is also provided for the edges 115 and 116, respectively of the material, because when the inner tube 26 is formed (as will be explained hereinbelow with reference to FIG. 5) webbing material 113 and 114 will reinforce the cut formed between the two joined ends 115 and 116.

As with the outer tube 24, the inner tube 26 has preferably four flaps 120, 121, 122, and 123 which are defined by the cut lines 110–112 and edges 115 and 116. The flaps 120–123 are preferably all of the same size and are about 10 to 16 inches wide, with about 12 to 15 inches being preferred and 12 to 24 inches long, with about 15 to 19 inches being preferred.

Disposed on each flap 120–123 is an upper row of bolt holes 130, 131, 132, and 133, each row containing three bolt holes **130*a–c* through 133*a–c* and a lower row of bolt holes 134, 135, 136, and 137 each row containing three bolt holes 134*a–c* through 137*a–c*. These bolt holes 130*a–c* through 137*a–c* are used to mount the inner tube 26 to the mounting bracket 22 as will be explained hereinbelow. The bolt holes 130*a–c* through 137*a–c* have the same diameter as each other which can range from $\frac{3}{8}$ to 1 inches with $\frac{1}{2}$ to $\frac{7}{8}$ inches being preferred. As can be seen from FIG. 4A, the upper row 130*a–c* through 133*a–c* bolt holes are generally longitudinally aligned with the lower row 134*a–c* through 137*a–c* bolt holes such that bolt hole 130*a* is aligned with bolt hole 134*a***, for example.

Figure 5:
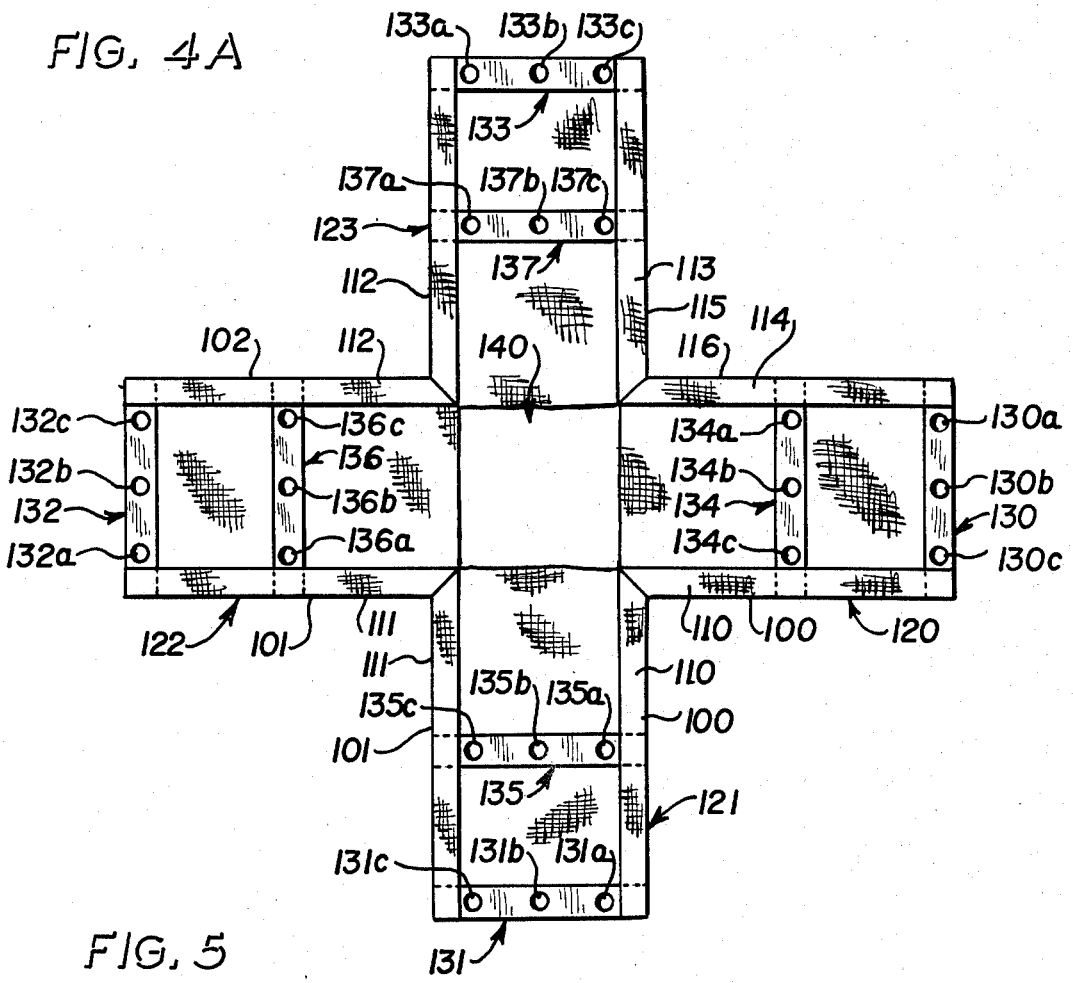
FIG. 5 is a top plan view of the inner tube of the escape chute which shows the ends of the tube joined to form the inner tube as will be subsequently mounted on the mounting bracket.

FIG. 5 shows a top view of the inner tube 26 before it is mounted on the mounting bracket 22 as will be explained hereinbelow. As can be seen, the flaps 120–123 are preferably oriented generally perpendicular to adjacent flaps and define an inner diameter opening 140 about 16 to 22 inches with 18 to 20 inches being preferred. This provides a tapered entry for the chute which will help to minimize fear of persons entering the chute. This tapered entry way will also create the air space between the inner tube 26 and the outer tube 24, which will be described hereinbelow.

Figure 6:
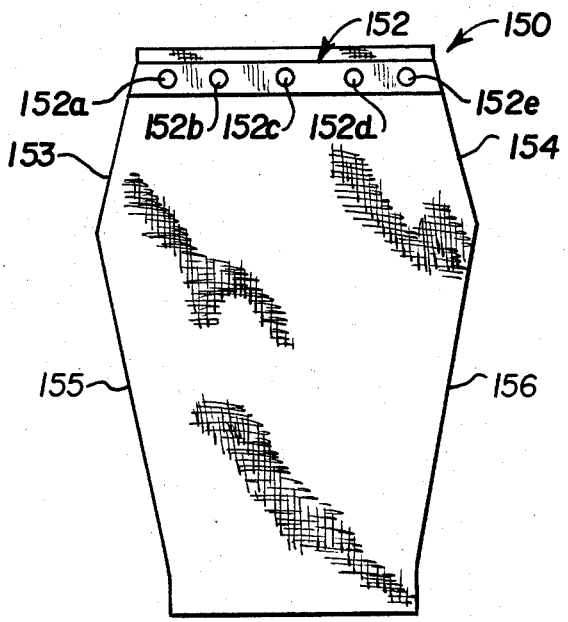
FIG. 6 is a front elevational view of one of the abrasion flap liners before it is mounted on the mounting bracket.

FIG. 6 shows the non-abrasive liner flap 150 before it is mounted on the mounting bracket 22. This is made of nylon and sold under the trade designation of "CORDURA" with a polyethylene coat of 1 to 5 mils in thickness.

The flap 150, in the form shown, has a single row of bolt holes 152 containing five bolt holes **152*a–e*. This flap 150 is about 20 to 40 inches long with about 28 to 36 inches being preferred. As can be seen in FIG. 6, the flap 150 has two angularly and outwardly disposed sides 153 and 154 and two angularly and inwardly disposed sides 155 and 156. The shape formed by these sides will facilitate mounting of the flap 150 onto the mounting bracket 22**.

It will be appreciated that only flap 150 is shown. Four such flaps will be employed in the final assembly of the escape chute. This will be discussed hereinbelow with respect to FIG. 7.

Figure 7:
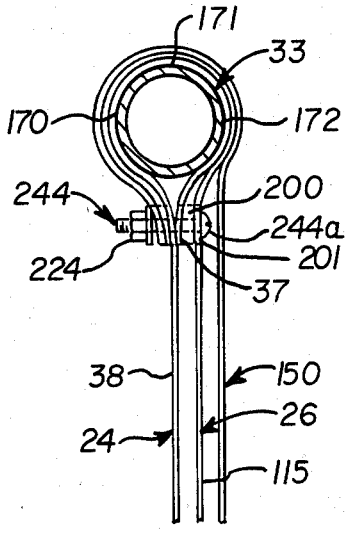
FIG. 7 is a cross-sectional view of a portion of a mounting bracket taken along line 7—7 of FIG. 1.

Referring now to FIG. 7 and FIG. 1, the mounting of the outer tube 24, inner tube 26, and non-abrasive flap 150 will now be discussed.

FIG. 7 shows a cross-sectional view of a mounting bracket member 33 of the mounting bracket 22. In mounting the outer tube 24 onto the chute, first the flaps 44–47 of the outer tube 24, as was described in FIG. 3 hereinbefore, are wrapped around the mounting bracket 22 by taking each flap 44–47 and wrapping it around the mounting bracket member 33 so that the upper row of bolt holes 70–73 are aligned with the lower bolt rows 74–77. FIG. 7 illustrates this with flap 44 and bolt hole rows 70 and 74. This is shown also in FIG. 1. Flap 44, as shown in FIG. 7, is mounted to the mounting bracket by wrapping the flap 44 from the outside 170 of the mounting bracket member 33 over the top 171 of the mounting bracket member 33 to the inside 172 of the mounting bracket member 33. The flap 44 is then positioned so that bolt holes **70*a–e* are aligned with bolt holes 74*a–e***.

After this, the inner tube 26 of FIG. 5 is similarly mounted on the mounting bracket 22 by taking the flaps 120–123 and wrapping them around the mounting bracket 22. As shown in FIG. 7, flap 120 is mounted on the mounting bracket 22 by taking the flap 120 of the inner tube 26 and wrapping it around the inside 172 of the mounting bracket member 33 over the top 171 of the mounting bracket member 33 and around the outside 170 of the mounting bracket member 33. As with the outer tube 24, the upper row bolt holes **130*a–c* should be aligned with the lower row bolt holes 134*a–c*, and this bolt hole alignment should be aligned with the middle three upper and lower row bolt holes 70*b–d* through 77*b–d* alignment of the outer tube 24**.

The flap 150 is wrapped from the inside 172 of the mounting bracket member 30 over the top 171 and around the outside 170 of the mounting bracket member 30 in a similar manner as was the inner tube 26. The bolt holes **152*a–e* should be aligned with the alignment of the inner tube 26 and outer tube 24 bolt holes, as was determined hereinabove with respect to the alignment of the inner tube 26 and outer tube 24 bolt holes. The other three abrasion flaps 28, 230, and 231 are similarly mounted to the mounting bracket 22**.

Once the bolt holes **70*a–e* and 74*a–e* of outer tube 24, 130*a–c* and 134*a–c* of inner tube 26, and 152*a–e* of the non-abrasive flap 150 are aligned and in the position shown partially in FIG. 1, an aluminum plate 200 having five holes 200*a–e* (200*e* is not shown) is placed between the outer tube 24 and the inner tube 26 on the inside overlap 201 of the inner tube 26 and outer tube 24. The bolt holes 200*a–e* of the plate 200 are then aligned with the aligned bolt holes of the outer tube 24, inner tube 26, and non-abrasive flap 150. Once this is done, five bolts 220–224 are placed in the aligned holes. These bolts 220–224 are fastened by respective nuts 240–244. It will be appreciated that the non-abrasive flap 150 will cover the head 241*a* of the bolt 241 as shown in FIG. 7**. This will prevent persons from ripping clothing or getting injured by an exposed bolt head when entering the chute.

It will be appreciated that the inner tube 26 has only three bolt holes in its upper row 130 and lower row 134, so that the middle bolts 221–223 engage the inner tube 26 bolt holes 130*a–c* through 134*a–c*, outer tube 24 bolt holes 70*b–d* through 74*b–d*, and abrasion flap 150 bolt holes 152*b–d* whereas the outer bolts 220 and 224 engage only the outer tube 24 bolt holes 70*a* and 70*e* and 74*a* and 74*e* and abrasion flap 150 bolt holes 152*a* and 152*e*.

It will be appreciated that this mounting method provides a secure and reliable support for escape chute. Because the inner tube 26 is not stitched to the outer tube 24 as was shown in the prior art, the outer tube 24 does not have any load-carrying duties and thus can be made of fire resistant materials that might not necessarily be strong and elastic. Because the inner tube 26 is totally surrounded by the fire resistant outer tube 24, there is greater protection for persons descending the chute and the inner tube 26 can be made from stronger more elastic materials that need not be fireproof.

Another feature of the invention can be seen in FIG. 1. Because of the smaller size of the inner tube 26, an air space 250 is formed between the outer tube 24 and the inner tube 26. The purpose of this is to allow fresh air to enter the space between the inner tube 26 and outer tube 24. As a person descends in the inner tube 26, expanding the diameter of the inner tube 26, air contained in the space 250 between the inner tube 26 and outer tube 24 is forced downwardly. Fresh, cooler air is sucked downwardly through the air space 250 at the top, replacing the air being forced down by the descending person. The amount of air forced down and replaced, of course, depends on the size of the person descending. This self-ventilating system will assure a constant flow of fresh air which will help to not only resist smoke inhalation of persons using the chute, but also, insulate and cool the inner tube 26, protecting the person from the heat of a fire raging in a building next to the chute.

In use, a person would enter the chute by means of a platform on a "cherry-picker" of a fire truck, for example, and would descend in the chute away from the emergency situation. The inner tube 26 will slow the person's descent and the design of the chute will protect the person from heat from the fire as well as smoke inhalation.

It will be appreciated, therefore, that the present invention provides an improved form of escape device which is adapted to safely and effectively assist persons in the evacuation of buildings. The separate mounting of the inner and outer tube provides a strong and reliable chute which has an air gap for insulation and ventilation purposes. All of this is accomplished in an effective, economical, and simple manner.

While the apparatus is advantageous for use with persons, it will be appreciated that it may also be used for animals or property.

Whereas particular embodiments of the invention have been described above for purposes of illustration it will be appreciated by those skilled in the art that numerous variations of the details may be made without departing from the invention as described in the appended claims.

I claim:

1. An escape device comprising a tubular escape chute having an upper end and a lower end, said chute having at least one outer tube and at least one inner tube, said outer tube extending substantially from said upper end to said lower end made of a heat resistant material and surrounding said inner tube, said inner tube extending substantially from said upper end to said lower end having a panel that extends over a major portion of said chute's length, mounting means having a mounting bracket supporting said upper end of said chute, said inner tube attached to said mounting bracket such that a tapered entry is provided in said upper end of said chute, and said outer tube attached to said mounting bracket independently of said inner tube whereby said outer tube does not have to support load-carrying stress associated with objects descending in said chute, and whereby an air gap is formed between said inner and outer tube so that insulation of said inner tube and replenishment of air in said chute is facilitated.

2. The device of claim 1, including said mounting bracket having a plurality of substantially rigid mounting members forming a rectangular shape.

3. The device of claim 2, including said mounting members being tubular.

4. The device of claim 1, including said outer tube having a plurality of flap means formed at said upper end.

5. The device of claim 4, including said outer tube flap means having a plurality of outer tube bolt hole row means.

6. The device of claim 5, including said outer tube bolt hole row means having a plurality of outer tube bolt holes being defined thereon.

7. The device of claim 6, including each said outer tube flap means having a first outer tube bolt hole row means and a second outer tube bolt hole row means in spaced apart relationship to each other.

8. The device of claim 7, including said first outer tube bolt hole row means being positioned substantially parallel to said second outer tube bolt hole row means, whereby said outer tube bolt holes of said first outer tube bolt hole row means and said outer tube bolt holes of said second outer tube bolt hole row means are substantially longitudinally aligned with each other.

9. The device of claim 8, including said outer tube being mounted on said mounting means by the upper end of said outer tube member being wrapped around said mounting bracket means, whereby said outer tube first bolt hole row means are aligned with said second outer tube bolt hole row means and said outer tube bolt holes of said outer tube first and second bolt hole row means are aligned.

10. The device of claim 9, including fastener means being placed through said outer tube bolt holes.

11. The device of claim 4, including said flaps being formed by a plurality of attached outer tube members.

12. The device of claim 11, including said outer tube members being attached by stitching together adjacent outer tube members.

13. The device of claim 12, including said stitching being Kelvar thread.

14. The device of claim 13, including said stitching being reinforced with webbing material.

15. The device of claim 1, including said inner tube being a piece of material having a top end, a bottom end, and two sides.

16. The device of claim 15, including having said upper end provided with a plurality of cut lines, whereby said cut lines form a plurality of inner tube flap means.

17. The device of claim 16, including said inner tube flap means having a plurality of inner tube bolt hole row means.

18. The device of claim 17, including said inner tube bolt hole row means having a plurality of inner tube bolt holes being defined thereon.

19. The device of claim 18, including each said inner tube flap means having a first inner tube bolt hole row means and a second inner tube bolt hole row means in spaced apart relationship to each other.

20. The device of claim 19, including said first inner tube bolt hole row means being positioned substantially parallel to said second inner tube bolt hole row means whereby said inner tube bolt holes of said first inner tube bolt hole row means and said inner tube bolt holes of said second inner tube bolt hole row means are substantially longitudinally aligned.

21. The device of claim 20, including said inner tube being mounted on said mounting means by the upper end of said inner tube being wrapped around said mounting bracket means whereby said first inner tube bolt row means are aligned with said second inner tube bolt hole row means and said inner tube bolt holes of said first and second inner tube bolt hole row means are aligned.

22. The device of claim 21, including fastener means being placed through said inner tube bolt holes.

23. The device of claim 1, including said panel being a friction-creating member, whereby an object descending in said chute and contacting said friction-creating panel will have its rate of descent retarded.

24. The device of claim 1, including said inner tube having an elongated pleated zone and an elastic material secured to said pleated zone for resisting opening of said pleats, whereby an object passing through said chute will be in intimate resiliently maintained contact with said inner tube.

25. The device of claim 24, including said panel containing an elongated pleated zone and an elastic material secured to pleated zone for resisting opening of said pleats, whereby an object passing through said chute will be in intimate resiliently maintained contact with said inner tube.

26. The device of claim 1, including non-abrasive flap means consisting of a piece of material having an upper and lower end and two sides and positioned at the upper end of said chute, whereby wear and tear on said inner tube and said outer tube is resisted.

27. The device of claim 26, including said non-abrasive flap means being mounted on said mounting bracket.

28. The device of claim 27, including said upper end having an non-abrasive flap bolt hole row means having a plurality of non-abrasive flap bolt holes.

29. The device of claim 26, including said inner tube, outer tube, and non-abrasive flap means being mounted on said bracket by means of a strip of metal having a plurality of bolt holes into which are engaged fastener means, whereby said metal strip bolt holes align with said inner tube, outer tube, and non-abrasive flap bolt holes, and said fastener means going through said metal strip, inner tube, outer tube, and non-abrasive flap bolt means, and holding said inner tube, outer tube, and non-abrasive flap means onto said mounting bracket.

* * * * *